US005168136A

United States Patent [19]

Thangavelu et al.

[11] Patent Number: 5,168,136

[45] Date of Patent: Dec. 1, 1992

[54] LEARNING METHODOLOGY FOR IMPROVING TRAFFIC PREDICTION ACCURACY OF ELEVATOR SYSTEMS USING "ARTIFICIAL INTELLIGENCE"

[75] Inventors: Kandasamy Thangavelu, Avon; V. Sarma Pullela, North Granby, both of Conn.

[73] Assignee: Otis Elevator Company, Farmington, Conn.

[21] Appl. No.: 776,105

[22] Filed: Oct. 15, 1991

[51] Int. Cl.[5] ..... B66B 3/00

[52] U.S. Cl. ..... 187/130; 187/127; 187/133

[58] Field of Search ..... 187/124, 127

[56] References Cited

U.S. PATENT DOCUMENTS

| | | | |
|---|---|---|---|
| 4,760,896 | 8/1988 | Yamaguchi et al. | 187/124 |
| 4,838,384 | 6/1989 | Thangavelu | 187/125 |
| 4,846,311 | 7/1989 | Thangavelu | 187/125 |
| 4,947,965 | 8/1990 | Kozunuki et al. | 187/127 |
| 5,022,497 | 6/1991 | Thangavelu | 187/124 |
| 5,024,295 | 6/1991 | Thangavelu | 187/125 |
| 5,035,302 | 7/1991 | Thangavelu | 187/125 |

*Primary Examiner*—A. D. Pellinen
*Assistant Examiner*—Lawrence E. Colbert
*Attorney, Agent, or Firm*—Breffni X. Baggot

[57] ABSTRACT

A computer controlled elevator system (FIG. 1 ) using prediction methodology to enhance the system's elevator service, having "learning" capabilities to adapt the system to changing building operational characteristics, including signal processing means for computing the "best" prediction model to be used for prediction, the best factoring coefficients for combining real time and historic predictors associated with the best prediction model, the best data and prediction time interval lengths to be used, and the optimal number of look-ahead intervals or steps (for real time predictions) or look-back days (for historic predictions) to the extent applicable to the prediction model, etc. Using the algorithm(s) of the invention the best prediction methodology and associated parameters are selected by running on site simulations based on exemplary values and comparing the prediction results to recorded data indicative of the actual events that have occurred in the system over a past appropriate period of time. That which provides the most accurate predictions, i.e., those with a minimum error as determined by appropriate mathematical models (e.g., sum of the square of the prediction error or sum of absolute error), are thereafter used in the prediction methodology of the system until further evaluations indicate that further changes should be made.

8 Claims, 4 Drawing Sheets

LEARNING METHODOLOGY FOR IMPROVING TRAFFIC PREDICTION ACCURACY OF ELEVATOR SYSTEMS USING "ARTIFICIAL INTELLIGENCE"

REFERENCE TO RELATED APPLICATIONS

This application relates to some of the same subject matter as the co-pending U.S. patent applications listed below, owned by the assignee hereof, the disclosures of which are incorporated herein by reference:

U.S. Pat. No. 5,024,295 of Kandasamy Thangavelu entitled "Relative System Response Elevator Dispatcher System Using Artificial Intelligence to Vary Bonuses and Penalties" filed on Mar. 3, 1989, which is in turn a continuation-in-part of U.S. Pat. No. 4,838,384 entitled "Queue Based Elevator Dispatching System Using Peak Period Traffic Prediction" filed Jun. 21, 1988, which incorporated by reference the disclosure of U.S. Pat. No. 4,846,311 entitled "Optimized 'Up-Peak' Elevator Channeling System With Predicted Traffic Volume Equalized Sector Assignments" of Kandasamy Thangavelu, likewise filed Jun. 21, 1988.

U.S. Pat. No. 5,022,497 of Kandasamy Thangavelu entitled "'Artificial Intelligence' Based Crowd Sensing System For Elevator Car Assignment" filed on Mar. 3, 1989, a continuation-in-part of U.S. Pat. No. 4,838,384, above;

U.S. Pat. No. 5,035,302 of Kandasamy Thangavelu entitled "'Artificial Intelligence' Based Learning System Predicting 'Peak-Period' Times For Elevator Dispatching" filed on Mar. 2, 1990, a continuation-in-part of U.S. Pat. No. 5,022,497, above;

Ser. No. 07/487,344 of Kandasamy Thangavelu entitled "'Up-Peak' Elevator Channeling System With Optimized Preferential Service to High Intensity Traffic Floors" filed on Mar. 2, 1990;

Ser. No. 07/508,319 of Zuhair S. Bahjat & V. Sarma Pullela entitled "Elevator System With Varying Motion Profiles And Parameters Based On Crowd Related Predictions" filed on Apr. 12, 1990; and Ser. No. 07/580,888 of Nader Kameli entitled "Behavior Based Cyclic Predictions for an Elevator System with Data Certainty Checks" filed on Sep. 11, 1990 and the applications cited therein, including Ser. No. 07/508,312 of Nader Kameli entitled "Elevator Dynamic Channeling Dispatching for Up-Peak Period" filed on Apr. 12, 1990;

Ser. No. 07/508,313 of Nader Kameli entitled "Elevator Dynamic Channeling Dispatching Optimized Based on Car Capacity" filed on Apr. 12, 1990;

Ser. No. 07/508,318 of Nader Kameli entitled "Elevator Dynamic Channeling Dispatching Optimized Based on Population Density of the Channel" filed on Apr. 12, 1990; and Ser. No. 07/580,905 of Nader Kameli entitled "Prediction Correction for Traffic Shifts Based in Part on Population Density" filed on Sep. 11, 1990.

TECHNICAL FIELD

The present invention relates to elevator systems and more particularly to elevator systems which are computer controlled and use prediction methodology to improve elevator service. Even more particularly, the present invention relates to a "learning" subsystem in which various prediction models are used to "learn" the best prediction factors to be used in controlling the elevator systems, including, for example, prediction methods, coefficients, data and prediction interval lengths, look-ahead intervals (for real-time predictions) and look-back days (for historic predictions), for "peak" as well as off-peak predictions.

BACKGROUND ART

In modern high rise buildings it is the preferred practice to use computer technology to control (at least in part) the dispatching of the cars of the elevator system.

Exemplary, current, computer controlled, dispatcher systems typically include:

several dispatcher algorithms applicable for various operational periods, such as, for example, up-peak, down-peak, noon-time and off-peak periods; and various traffic predictions to predict, for example lobby-generated and lobby-oriented traffic for short intervals in terms of passenger boarding and de-boarding counts and car arrivals and departures, and floor traffic in terms of passengers boarding and de-boarding in the "up" and "down" directions for short intervals and car arrivals and departures in the "up" and "down" directions for short intervals. These predictions are made for up-peak, down-peak and noon-time periods, as well as for other periods.

The traffic is predicted using, for example, data collected for the past several days for various short intervals. This can be termed "historic" prediction and can use, for example, simple moving averages over several days or exponential smoothing in using the "historic" data in making predictions.

The traffic typically is also predicted using data collected on the current day for several short intervals. This can be termed "real-time" prediction and uses, for example, doubles moving averages [see, for example, U.S. Pat. No. 4,846,311 referred to above] or linear exponential smoothing.

The historic and real-time predictions typically are combined to obtain optimal predictions using, for example, linear relationships. The historic and real-time predictions can also use, for further example, simple and multiple regression models and auto-regressive moving average models [for background on these further models, see, for example, *Forecasting Methods and Applications,* by Makridakis and Wheelwright (John Wiley & Sons, New York, N.Y.), Part 3 ("Regression Methods"), Chapters 5 ("Simple Regression") and 6 ("Multiple Regression") and Part 4 ("AutoRegressive/Moving Average Time-Series Methods"), etc.], as well as other filtering techniques.

Exemplary elevator applications of some of these prediction techniques for elevator systems are noted below:

1. To select optimal sectors for dynamic channeling.

In U.S. Pat. No. 4,846,311 there is an estimation of the future traffic flow levels of various floors, for, for example, each five (5) minute interval for enhanced channeling and enhanced system performance. This estimation can be made using traffic levels measured during the past few time intervals on the given day, namely as "real time" predictors, and, when available, using traffic levels measured during similar time intervals on previous days, namely as "historic" predictors. The estimated traffic is then used to intelligently group floors into sectors, so that each sector ideally has equal traffic volume for each given five (5) minute period or interval. Such intelligently assigned sectoring reduces passenger queues and the waiting times at the lobby by achieving more accurate uniform loading of the cars of the elevator system. The handling capacity of the elevator system is thus significantly increased.

2. To determine the number of people waiting behind the hall call and to dispatch cars so as to give priority to the floors having larger numbers of people predicted to be waiting, as in queue-based dispatching.

In U.S. Pat. No. 4,838,384 the elevators are efficiently dispatched during peak periods by collecting traffic data in the building and predicting passenger traffic levels as functions of time, a few minutes before the occurrence of the specific levels, based on the past several similar days' and the current day's traffic data, and dispatching the cars using a priority scheme based on the number of people waiting behind the hall calls and the past or expected waiting times of the hall calls. This approach thus utilizes methods of lobby oriented or lobby generated traffic data collection at the lobby and upper floors during the "up-peak" period, the "down-peak" period and noon-time for storage in historic and real time data bases, and uses the historic and real time data to predict passenger traffic levels for short time intervals for various periods of the given day.

3. To determine the floors where crowds are accumulating and to give priority service to such floors by assigning more than one car to such crowded floors.

In U.S. Pat. No. 5,022,497 "artificial intelligence" techniques are used to predict the traffic levels and any crowd build up at the various floors, and these predictions are used to better assign one, two or more cars to the "crowd" predicted floors, either parking them there, if they were empty, or, if in active service, more appropriately assigning the car(s) to the hall calls. Part of the strategy of such a system is the accurate prediction or forecasting of traffic dynamics in the form of "crowds" preferably using single exponential smoothing and/or linear exponential smoothing and numerical integration techniques. Thereby the traffic levels at various floors are predicted by collecting the passengers and car stop counts in real time and real time, and using historic (if available) and real time predictions for the traffic levels, with the real time and historic predictions being relatively weighted using relative factoring coefficients whose summation is unity; i.e. $a+b=1$, in which $$X=ax_h+bx_r$$

where "X" is the combined prediction, "$x_h$" is the historic prediction and "$x_r$" is the real time prediction and "a" and "b" are multiplying factors.

4. To predict the people waiting behind a hall call and the car load when the car reaches a hall call floor so as to match the car's spare capacity with the number of people waiting behind the hall call; to minimize excessive stopping of heavily loaded cars; to distribute car loads and stops, etc.,—by enhancing the penalties used in a Relative System Response (RSR) algorithm.

See, U.S. Pat. No. 5,024,295 the elevator cars are dispatched using an algorithm with variable bonuses and penalties using "artificial intelligence" techniques based on historic and real time traffic predictions to predict the number of people behind a hall call, the expected boarding and de-boarding rates at en route stops, and the expected car load at the hall call floor, and varying the RSR bonuses and penalties based on this information to distribute car loads and stops more equitably.

5. To provide preferential service for heavy sectors during up-peak channeling by varying the frequency of service with predicted traffic level.

In U.S. application Ser. No. 07/487,344 above, floors are grouped into sectors which are provided with different frequencies of service based on traffic volume (thus varying the time interval between successive assignments of cars for a sector), so that all cars carry a more nearly equal traffic volume. As a result, the queue length and waiting tire at the lobby can be decreased and the handling capacity of the elevator system increased. "Today's" traffic data is used to predict future traffic levels for a quick response to the current day's traffic variations. Additionally, the efficiency and effectiveness of the system is significantly enhanced by the use of linear exponential smoothing in the real time prediction and of single exponential smoothing in the historic prediction, the use combining of both of them with varying multiplication factors to produce optimized traffic predictions, efficiency and effectiveness of the system.

6. To predict the start and end of peak periods, such as up-peak, down-peak and noon time.

In U.S. application Ser. No. 07/487,574 above passenger boarding and de-boarding counts at the lobby and the car arrival and departure counts at the lobby are collected for each short interval each day. Based on such counts for several days the passenger counts and car counts for the next day are predicted. These counts are also predicted in real time using the current day's data. The real time and historic predictions are then combined to get optimal predictions of passenger counts and car counts for each interval. The peak period starting and ending times are based on the times when the predicted passenger boarding counts or de-boarding counts for the next interval reach specified levels, as a first method. In second method, the lobby boarding rate is calculated using the lobby passenger counts and car departure counts. The lobby de-boarding rate is calculated using the lobby passenger de-boarding counts and car arrival counts. In this second method the times when lobby boarding rate or de-boarding rate reach predetermined levels are used as the start or end of the peak periods. For higher reliability, the peak period times predicted using passenger counts and the peak period times predicted using passenger boarding and de-boarding rates are combined, preferably using a linear function, and used as optimal predictions.

7. To vary the door dwell time at each floor based on the predicted number of people de-boarding and boarding cars at that floor.

In U.S. application Ser. No. 07/508,321 referred to above using appropriate "artificial intelligence" (AI) logic involving, for example, real time and historic predictors, the predicted average number of people boarding the car at each hall call stop and the predicted average number of people de-boarding the car at each car call stop is calculated. Then, the needed passenger transfer time based on the predictions are computed as a function of the car's remaining capacity after de-boarding but before boarding, the total predicted passenger transfer counts and the car size (i.e., total capacity), with these factors then related with an appropriate formula to vary the door dwell times.

Although all of the foregoing elevator applications represent substantial advances in the art, they have not yet reached ultimate perfection under all operational circumstances, particularly where the building's traffic needs are varying in a non-cyclical or non-uniformly repeating pattern.

For example, in the prior use of the foregoing prediction methodologies, the prediction algorithms for a particular elevator system are selected by an elevator systems researcher in the laboratory using limited data collected for limited time period(s) at one or a few buildings. The researcher applies a limited set of algorithms, such as simple moving average, exponential smoothing, double moving average, and linear exponential smoothing (note, e.g. U.S. Pat. Nos. 4,838,384 and 4,846,311 referred to above) to historic and real-time data.

He selects for those algorithms the data collection time intervals based on his best judgement, typically in the range of one (1) minute to five (5) minutes.

He then selects a range of values for the prediction coefficients. He conducts experiments with different combinations of prediction models, data and prediction intervals, prediction coefficients, look-back days (for historic predictions) and look-ahead intervals (for real-time predictions).

Using a criterion of minimizing the sum of the square of prediction errors of the intervals of the period over several days or minimizing the sum of absolute prediction errors of various intervals of the period over several days, the researcher then selects what he feels would be the optimal combination of prediction models, data and prediction intervals, prediction coefficient values, look-back days and look-ahead intervals, etc. The set of values are then typically hard-coded in the prediction algorithms, and then these prediction algorithms are used in all types of buildings, even though they may have traffic patterns varying continuously from day-to-day, forever.

Thus, in this prior approach, the prediction models, the data and prediction intervals, the prediction coefficients, the look-back days (for historic predictions) and look-ahead intervals (for real-time predictions) did not vary with the buildings based on the nature of traffic variations in the buildings.

Hence the selected prediction algorithms and parameters would not result in optimal predictions in all buildings under all circumstances and at all times and thus may not be adequately responsive to future variations in traffic under certain conditions.

DISCLOSURE OF INVENTION

The present invention overcomes these prior art problems by providing a "built-in," "artificial intelligence" based, automated learning system, which learns the best prediction models, data and prediction intervals, prediction coefficient values, look-back days (for historic predictions) and look-ahead intervals (for real time predictions) applicable to the building and the traffic variations in that building.

It automatically achieves this by conducting, preferably on the computer used to control the elevator system, simulations (experiments) of traffic prediction using data collected over the past, for example, twenty (20) days, including the current day, in that building throughout the day.

The past twenty (20) days of data are collected, for example, for each minute interval for all floors for the "up" and "down" directions and saved in large disk files maintained, for example, on the hard disk of the microcomputers in the advanced dispatcher subsystem (ADSS; described more fully below) of the elevator system.

From the one minute traffic data, the traffic data for example, for two (2), three (3), four (4) or five (5) minute intervals, are obtained by simple additions of data of the pertinent several intervals.

The simulation experiments preferably are conducted separately for lobby boarding and de-boarding and for floor boarding and de-boarding. The experiments are also conducted separately for up-peak, down-peak, noon time and other periods. Thus there are several sets of experiments conducted, each set being applicable to one floor, one traffic pattern and one time period.

The experiments are conducted using different prediction models, data and prediction intervals, prediction coefficients and look-back days and look-ahead intervals.

The prediction method that results in a minimum value of, for example, the sum of the square of the prediction error (or some other mathematically acceptable, error checking criterion, such as, for further example, the sum of absolute error, etc.) is then selected to be the best historic method. [For background information on these established mathematical techniques, see, for example, Section 2.2 ("Fundamentals of Quantitative Forecasting—Least Squares Estimates;" pp. 17–22) of the *Makridakis and Wheelwright* text cited above.]

Experiments are conducted for, for example, days "15," "16," "17," "18," "19" and "20," for the selected time period. The simulation results are analyzed and, for example, the sum of square of prediction errors of each interval is computed for the prediction period for that day. From the experimentally computed results, the combination of prediction model, data and prediction interval, prediction coefficient and look-back days or look-ahead intervals that result in, for example, the least sum of squares of prediction errors over the prediction period is determined and selected.

Because a significant amount of computational or computer power and time is needed to run these simulations, analysis and selections, the algorithmic routines will typically be run during an off-peak period, for example, late at night as part of, for example, the historic prediction routines then being implemented in the system.

This combination of prediction methodology and prediction parameters is used for the next several days for each relevent period. The experiments are conducted once a week, or every few days, to determine and "learn" the latest "best" applicable models and parameters.

Thus, different sets of programmed "experiments" which are automatically run on the system's computer ultimately result in the selection of the best combinations of prediction models and parameters for different periods and traffic patterns.

The methodology of the invention thus introduces automatic simulations of traffic predictions using various models and parameter values, with an analysis of the simulation results, making conclusions based on the analysis and then selecting the best combination for each operational period and traffic pattern.

In essence, the automated learning system of the invention, which resides, for example, in the advanced dispatcher subsystem (ADSS; described more fully below), is added to and intercommunicates with the elevator traffic data collector and predictor of the system, which also resides in the ADSS. The elevator traffic data collector and predictor of the system in turn intercommunicates with the over-all elevator car "dispatcher," which includes both the operational control subsystem (OCSS; also described more fully below) and the ADSS.

The automated learning system of the present invention thus involves a prediction simulation (experimentation), evaluation and learning system. It is responsive to variations in traffic patterns in a building and is thus an adaptive controller. It selects the models and parameters to be used in the actual traffic prediction system that predicts traffic for each period and determines the best dispatch strategies and parameters.

As a result, the prediction methodologies in use and their parameters are selected and updated over time for the operating conditions that may then exist in the elevator system, providing more accurate predictions and more efficient operation of the system.

Thus, the approach of the invention provides better service for the elevator system than would otherwise have been achieved by less accurate, less appropriate prediction methodology.

The invention may be practiced in a wide variety of elevator systems, utilizing known technology, in the light of the teachings of the invention which are discussed herein in some further detail.

Other features and advantages will be apparent from the specification and claims and from the accompanying drawings, which illustrate an exemplary embodiment of the invention.

BEST MODE FOR CARRYING OUT THE INVENTION

First Exemplary Elevator Application

For the purposes of detailing a first, exemplary elevator system, reference is had to the disclosures of U.S. Pat. No. 4,363,381 of Bittar entitled "Relative Systems Response Elevator Car Assignments" (issued Dec. 14, 1982) and Bittar's subsequent U.S. Pat. No. 4,815,568 entitled "Weighted Relative System Response Elevator Car Assignment With Variable Bonuses and Penalties" (issued Mar. 28, 1989), supplemented by U.S. Pat. No. 5,024,295 (above), as well as of the commonly owned U.S. Pat. No. 4,330,836 entitled "Elevator Cab Load Measuring System" of Donofrio & Games issued May 18, 1982, the disclosures of which are incorporated herein by reference.

One application for the present invention is in an elevator control system employing microprocessor-based group and car controllers using signal processing means, which through generated signals communicates with the cars of the elevator system to determine the conditions of the cars and responds to, for example, hall calls registered at a plurality of landings in the building serviced by the cars under the control of the group and car controllers, to provide, for example, assignments of the hall calls to the cars. An exemplary elevator system with an exemplary group controller and associated car controllers (in block diagram form) is illustrated in FIGS. 1 and 2, respectively, of the '381 patent and described in detail therein, as well as in some of the related applications referred to above.

The makeup of micro-computer systems, such as may be used in the implementation of the elevator car controllers, the group controller, and the cab controllers can be selected from readily available components or families thereof, in accordance with known technology as described in various commercial and technical publications. The micro-computer for the group controller typically will have appropriate input and output (I/O) channels, an appropriate address, data and control bus and sufficient random access memory (RAM) and appropriate read-only memory (ROM), as well as other associated circuitry, as is well known to those of skill in the art. The software structures for implementing the present invention, and the peripheral features which are disclosed herein, may be organized in a wide variety of fashions.

Additionally, for further example, the invention could be implemented in connection with the advanced dispatcher subsystem (ADSS) and the operational control subsystems (OCSSs) and their related subsystems of the ring communication system of FIG. 1 hereof as described below.

Figure 1:
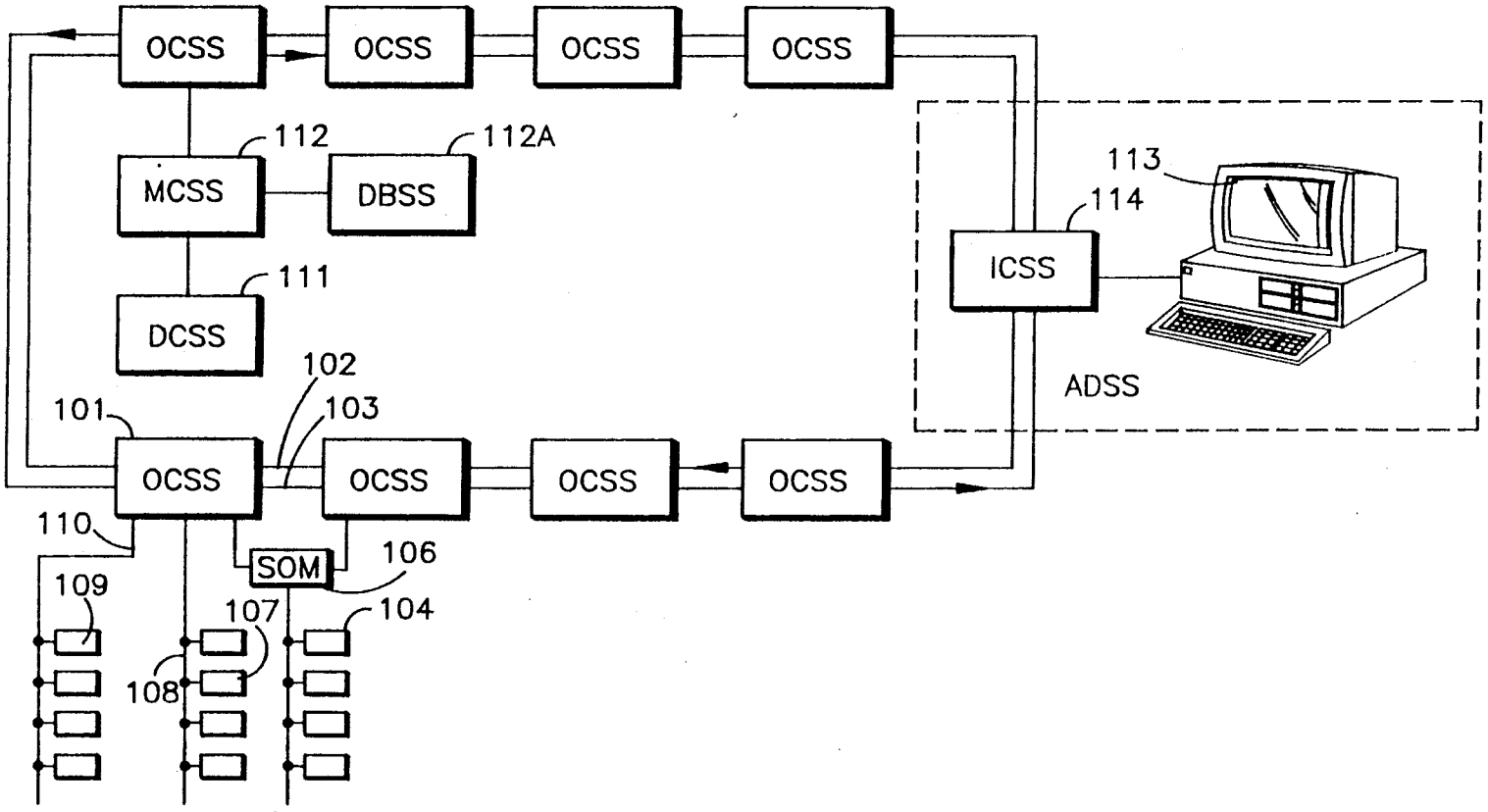
FIG. 1 is a simplified, schematic block diagram of an exemplary ring communication system for elevator group control employed in connection with the elevator car elements of an elevator system and in which the invention may be implemented in connection with the advanced dispatcher subsystem (ADSS) and the cars' individual operational control subsystems (OCSS) and their related subsystems.

Exemplary Ring System (FIG. 1)

As a variant to the group controller elements of the system generally described above and as a more current application, in certain elevator systems, as described in co-pending application Ser. No. 07/029,495, entitled "Two-Way Ring Communication System for Elevator Group Control" (filed Mar. 23, 1987), the disclosure of which is incorporated herein by reference, the elevator group control may be distributed between separate microprocessors, one per car. These microprocessors, known as operational control subsystems (OCSS) 100, 101, are all connected together in a two-way ring communication (102, 103). Each OCSS 100, 101 has a number of other subsystems and signaling devices, etc., associated with it, as will be described more fully below, but basically only one such collection of subsystems and signaling devices is illustrated with respect to the OCSS 107 in FIG. 1 for the sake of simplicity.

The hall call buttons and lights are connected with remote stations 104 and remote serial communication links 105 to the OCSS 101 via a switch-over module 106. The car buttons, lights and switches are connected through similar remote stations 107 and serial links 108 to the OCSS 101. The car specific hall features, such as car direction and position indicators, are connected through remote stations 109 and remote serial link 110 to the OCSS 101.

The car load measurement is periodically read by the door control subsystem (DCSS) 111, which is part of the car controller. This load is sent to the motion control subsystem (MCSS) 112, which is also part of the car controller. This load in turn is sent to the OCSS 101.

DCSS 111 and MCSS 112 are micro-processors controlling door operation and car motion under the control of the OCSS 101, with the MCSS 112 working in conjunction With the drive and brake subsystem (DBSS) 112A.

The dispatching function is executed by the OCSSs 100, 101, under the control of the advanced dispatcher subsystem (ADSS) 113, which communicates with the OCSS 101 via the information control subsystem (ICSS) 114. The car load measured may be converted into boarding and de-boarding passenger counts using the average weight of a passenger by the MCSSs 112 and sent to the OCSSs 100, 101. The OCSS send this data to the ADSS 113 via the ICSS 114.

The ADSS 113, through signal processing, inter alia, collects the passenger boarding and de-boarding counts and car arrival and departure counts at the various floors, so that, in accordance with its programming, it can analyze the traffic conditions at each floor, particularly its boarding and de-boarding counts. The ADSS 113 also collects other data for use in making predictions, etc.

For further background information reference is also had to the magazine article entitled "Intelligent Elevator Dispatching Systems" of Nader Kameli & Kandasamy Thangavelu (*AI Expert*, Sep. 1989; pp. 32–37), the disclosure of which is also incorporated herein by reference.

Owing to the computing capability of the "data processing," the system can collect data on individual and group demands throughout the day to arrive at a historical record of traffic demands for each day of the week and compare it to actual demand to adjust the overall dispatching sequences to achieve a prescribed level of system and individual car performance. Following such an approach, car loading and floor traffic may also be analyzed through signals from each car that indicates for each car the car's load at each floor. Alternatively, passenger sensors, which sense the number of passengers passing through each elevator's doors, using for example, infra-red sensors, can be used to get car boarding and de-boarding counts for car stops at floors other than the lobby and for car arrival and departure at the lobby.

Using such data and correlating it with the floor involved and, if so desired, the time of day and preferably the day of the week, meaningful, historically based, measures of building floor population and traffic can be obtained on a floor-by-floor basis.

Such information is collected in one or more data base files on the hard disk of the ADSS microcomputer 113. Using appropriate programming and following the exemplary algorithm described more fully below, the microcomputer system is used to run various simulations, calculations and comparisons using the data in its data base files to derive the "best" prediction model to be used for prediction, the best coefficients associated with the prediction method, the best data and prediction interval lengths to be used, and the optimal number of look-ahead steps or look-back days (to the extent applicable to the model), etc.

The "learning" mechanisms or algorithms of the invention preferably are run after the actual applicable elevator system data has been collected. The actual data is collected in intervals of the smallest unit—say, for example one (1) minute. Therefore, the algorithms will not be running to full advantage when first initiated in a given elevator group.

During this interim, data collection time period, which can go on, for example, for at least several days (e.g. ten days), an exemplary prediction methodology with associated exemplary parameters can be used so that some advantages of the use of prediction methodology can be realized during this start-up, data collection period.

Ultimately, after running the algorithms, the learned best prediction methodology and optimized prediction parameters are then subsequently used in the system. Every so often, at e.g. several days interval (e.g. weekly or every ten days), as may be desired, the "learning" algorithms are re-run either to ensure the currency of the previously, selected methodology and parameters for further use, or to change them, as appropriate for the then current conditions of the system.

Figure 2A:
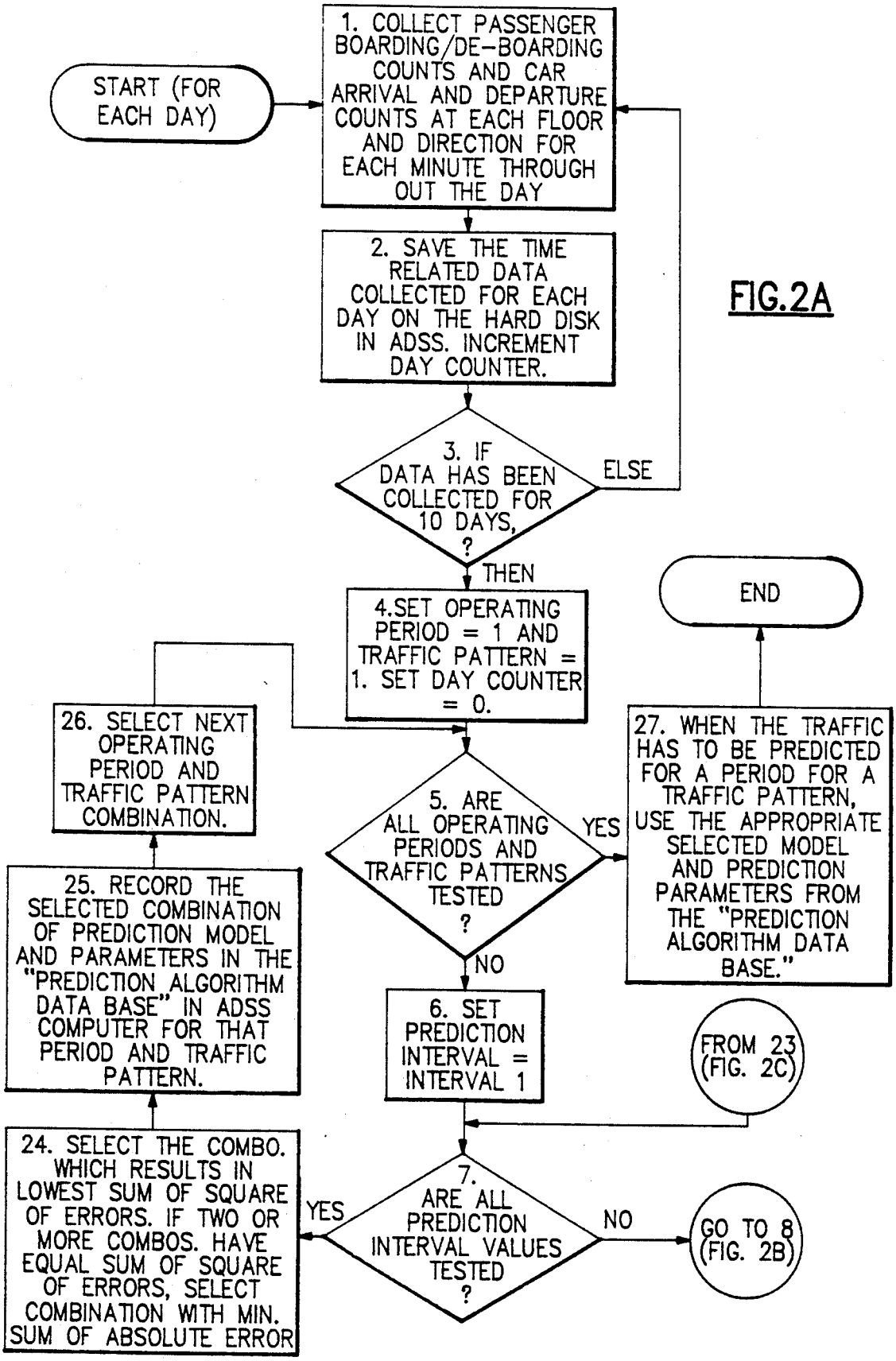
FIG. 2 (including in combination subFigures 2A, 2B and 2C) is a simplified, logic flow chart or diagram of an exemplary algorithm for the methodology used in "learning" the best prediction model and parameters to be used for prediction in accordance with the invention.
Figure 2B:
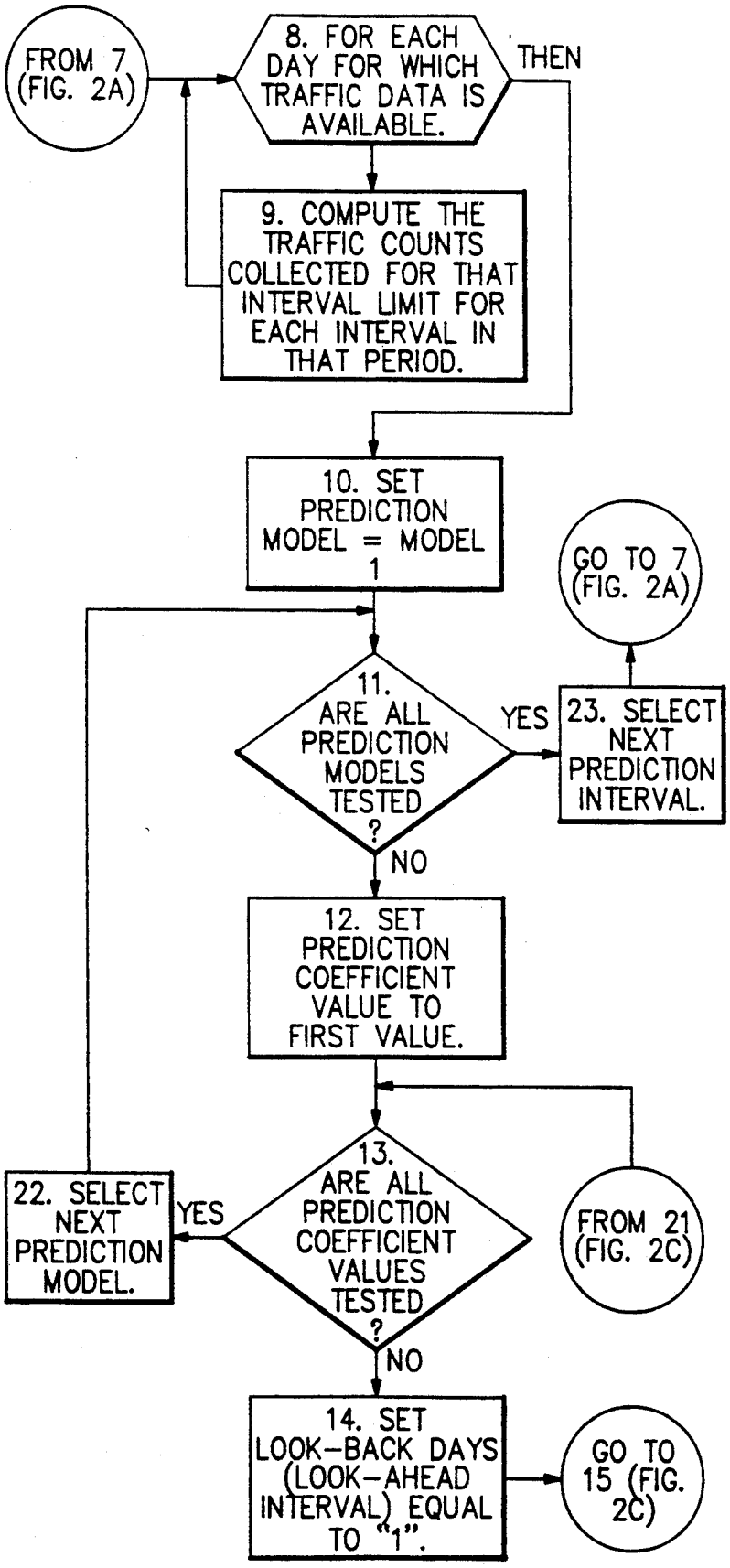
Figure 2C:
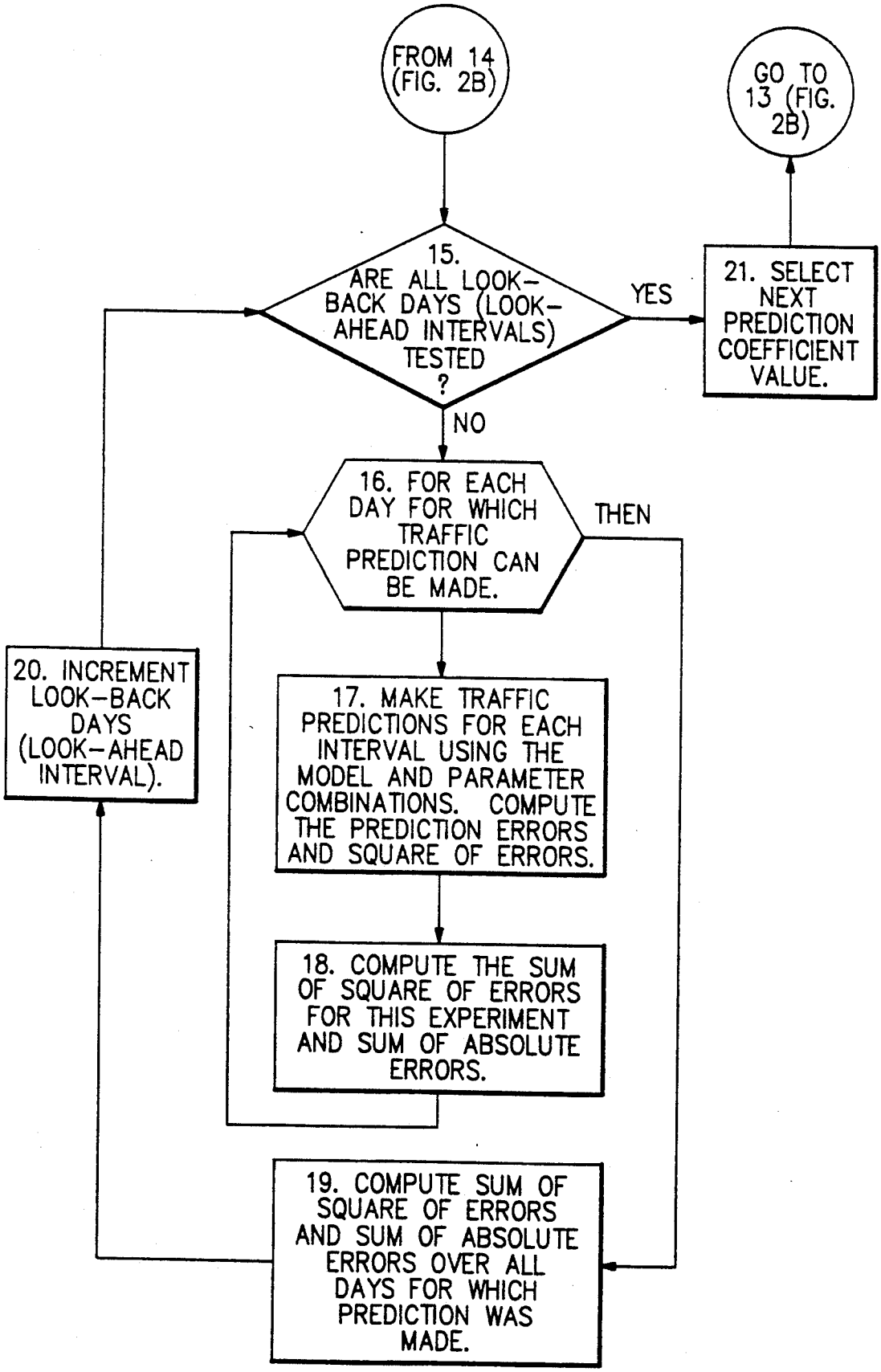

Exemplary Algorithm for Determining Best Prediction Model, Etc. (FIGS. 2A–C)

As generally illustrated in FIG. 2 (including in combination subFigures 2A, 2B and 2C), exemplary logic which can be used in the present invention for determining the best prediction model and associated parameters for each operating period and traffic pattern is set out on a step-by-step basis.

As illustrated, in step 1 the passenger boarding & de-boarding counts and car arrival and departure counts at each floor and direction is collected each minute throughout the day, and the data for that day is saved on the hard disk (tape, optical disk etc.) of the microcomputer 113 of the ADSS (step 2). This data collection and recording is repeated on subsequent days by passing through steps 1–3 until a minimum number of days has elapsed.

In step 3, if sufficient data is available to make use of the learning process of the invention, namely, for example, if ten (10) days' data has been recorded, then, for each operating period (up-peak, down-peak, etc.) and traffic pattern (boarding and de-boarding at the lobby and at other floors) in steps 4–25 the "best" combination of prediction model and associated parameters is ultimately determined in the manner described more fully below, and the selected "best" combination recorded in the ADSS data base. This is done separately for each operating period and traffic pattern, after the values for them have been set to their initial values of one in step 4.

In steps 10+ through looped step 22 (until step 11 determines that all models have been tested), the on-site simulation or experimentation uses in individual, sequential fashion a number of different prediction models which are programmed into the system, some of which are discussed in detail in various ones of the above referenced, related applications [note particularly U.S. Pat. No. 4,846,311 ] including, for example:

simple moving average,
double moving average,
exponential smoothing, and/or
linear exponential smoothing.

Other exemplary models (note, for example, the *Makridakis & Wheelwright* text cited above) include:

quadratic smoothing,
linear regression,
multiple regression,
auto regression, and
auto regressive moving average models, etc.

The exemplary algorithm in steps 6+ sets (and by thereafter looping through the various subsequent steps coming back from step 23), tests various prediction intervals for the prediction model then under test, using for each model interval values of, for example, one (1) minute, two (2) minutes, three (3) minutes, four (4), minutes and then five (5) minutes for the lobby and all other floors. Each operating period is broken into several or a number of intervals of the specified length. This interval experimentation continues until step 7 determines that all of the programmed interval values have been tested.

After the initial interval values have been set in step 6 and the prediction model to be experimented with has been set to model 1 in step 10, the initial prediction coefficient value(s) is/are set in step 12 (and subsequently varied and re-selected from step 21).

For exponential smoothing, the prediction coefficient can be varied in the range of, for example, one tenth (0.1) to a half (0.5) in increments of, for example, five-hundredths (0.05). Thus in step 12 the coefficient value is initially set to "0.1". Each time step 21 is looped through, the value is incremented by "0.05" until the value reaches "0.5," in which case until step 13 determines that all coefficient values for that model have been tested.

A similar approach can be used to select the ranges of the prediction parameter values for other models then under test (varied in step 22) and to select appropriate discrete, incrementing points for conducting trials or experiments for the parameter values for that particular model.

When moving average or methods requiring several look back days of data are involved, the modeling period is selected in the range of, for example, five (5) days to fifteen (15) days, e.g. five (5), seven (7), nine (9), eleven (11), thirteen (13) and fifteen (15) days.

When linear exponential smoothing or other real-time models are involved, look-ahead intervals of, for example, one (1), two (2), three (3) and four (4) days are selected and used in steps 14+ through incrementing looping step 20, until step 15 determines that all have been tested.

Thus, experiments or trials are conducted using different combinations of prediction models, prediction coefficient parameters, look-ahead intervals & look-back days, to the extent they are relevant to the model being tested, and prediction intervals. For each experiment, the predictions are made, for example, for the 15th 16th, 17th, 18th, 19th and 20th days, i.e. several days for that operating period and traffic pattern.

The predictions are compared against the actual traffic counts for each interval, and the prediction error is computed (note steps 17 and 18). In one exemplary method, the prediction errors are squared and summed over all intervals of that period. In an alternative or comparative method, the absolute values of prediction errors are summed for that period.

Then the summed values are summed over several days of prediction for that period and traffic pattern (note step 19). This sum is a measure of the accuracy of the prediction for that period. Thus each experiment for that period and traffic pattern results in one value of the sum of square of errors and sum of absolute errors.

Then in step 24 the combination of prediction model, prediction interval, prediction parameters and coefficients that results in a minimum value of, for example, the sum of square of errors and/or sum of absolute errors (or some other mathematically acceptable, error checking criterion) is selected as the preferred "best" prediction set for that particular period and traffic pattern. As indicated in step 24, the preferred, exemplary approach is to base the selection on the combination which produces the minimum sum of square of errors, and, if two or more combinations have an equal minimum sum of square of errors, then that which has the minimum sum of absolute errors is selected as the "best."

In step 25 the corresponding model and parameters are recorded in, for example, the data base on the hard disk of the microcomputer 113 in ADSS for that period and traffic pattern.

By looping back up to and through step 5, until the step indicates that all periods and traffic patterns have been tested, similar sets of experiments are conducted for other operating periods and traffic patterns. In step 24 the preferred combination of prediction model, prediction interval and pertinent parameter sets are selected for each operating period and traffic pattern. The "learning" process of the invention is then ended until it is re-initiated after a pre-set further passage of time (e.g. ten days; note step 3), and the learning process of steps 4+ are then repeated.

When traffic predictions are made for the next day and subsequent days, in step 27 the models and parameters selected and recorded in the data base are used by the regular traffic predictor to predict historic and real-time data.

Thus, the automated learning system can start the simulations and experimentation process, as soon as sufficient minimum data have been collected, as determined by step 3, for example, for ten (10) days. Initially, since there is data only for a limited number of days, the look-back days preferably would not be varied. Instead the value for the number of days used for looking back for historic based predictions preferably is preliminarily set and maintained during that period to a specified number of days, for example, eight (8), and predictions made for days "8," "9" and "10." Then the best models and parameters are selected as the combination resulting in the minimum sum of square (or absolute) error, based on these three (3) days' predictions.

In the subsequent week, when data has been collected for, for example, fifteen (15) days, the look-back days can be varied from, for example, five (5) to ten (10), and predictions made for days "10," "11," "12," "13," "14" and "15" used to select optimal combinations.

When, for example, twenty (20) days' data has been collected, the look-back days will then be varied from, for example, five (5) to fifteen (15), and the predictions for days fifteen (15) to twenty (20) days will be used to select optimal prediction sets.

After the exemplary twenty (20) days, preferably only the data for the previous twenty (20) days will be used for all experimentation, evaluation and learning.

Such procedures preferably are followed to select in steps 5+ the best prediction model and associated parameters for the following operating periods and traffic patterns:

the operating periods of up-peak, down-peak, noontime and other periods; and the traffic patterns of lobby "up" boarding counts, lobby "down" de-boarding counts, and upper floor boarding counts and upper floor de-boarding counts in the "up" and "down" directions.

Thus, after the algorithm of FIG. 2 is run, the prediction methodology and associated parameters have been optimized for the system as then presently constituted. Because fundamental conditions in the building which the elevator system is serving typically will change over time, the algorithm preferably should be run every so often, for example, once a week or once every five (5) days or every ten (10) days, to ensure the currency and best mode aspects of the prediction methodology, and the selections updated as needed.

Alternatively, rather than keying the re-initiation of the learning process of the invention based on a preset number of days, other approaches could be used. For example, the process could be triggered by evaluating the accuracy of the prediction models and associated parameters in comparison to the actual events which then take place, and, when, for example, a maximum amount of error occurs, re-initiating the learning process to possibly re-select a different model or a different set of related parameters to cure the detected prediction errors.

The learning mechanisms of the present invention thus generate more accurate predictions and enables the system to adapt to changes in the behavior of the building, further enhancing the accuracy provided by the invention.

Although this invention has been shown and described with respect to exemplary embodiments thereof, it should be understood by those skilled in the art that various changes in form, detail, methodology and/or approach may be made without departing from the spirit and scope of this invention.

We claim:

1. A computerized method of dispatching elevator cars to respond to hall calls and serve lobby traffic including enhancing elevator system traffic prediction methodology and associated parameters used in the system for car dispatching operations, for a building having multiple floors and multiple elevator cars to serve those floors, comprising the following steps:

(a) recording on a time and day related basis data indicative of elevator traffic events as they occur in the elevator system over a period of a number of days;

(b) running predictions on a computer using some portion of the recorded data relating to look-back days as historical data to predict future elevator traffic events, and using varying combinations of each of the following
multiple prediction models,
multiple prediction coefficient values related to the models, and
multiple prediction time intervals;

(c) comparing the predictions to another portion of the recorded data relating to look-ahead days subsequent to said look-back days and evaluating the relative accuracy of the predictions;

(d) recording information indicative of the performance of the more accurate combinations of prediction model, coefficient value and interval value and selecting one of the more accurate combinations for use in predicting traffic events in the system for guidance in dispatching the elevator cars of the system; and (e) dispatching cars to answer calls for service in response to predictions made using a selected one of said more accurate combinations.

2. The method of claim 1, wherein there is further included in step "b" the step of:
also testing the prediction combinations with historical data in said some portion of the recorded data relating to varying numbers of look-back days.

3. The method of claim 1, wherein there is further included in step "b" the step of:
also testing the prediction combinations with data in said another portion of the recorded data relating to varying numbers of look-ahead days.

4. The method of claim 1, wherein step "c" includes:
mathematically evaluating the accuracy of the predictions using a square of the errors model.

5. The method of claim 4, wherein step "c" includes:
mathematically evaluating the accuracy of the predictions using an absolute sum of the errors model and, if more than one combination has the lowest square of the errors value, selecting the combination with the lowest absolute sum of the errors value.

6. The method of claim 1, wherein step "c" includes:
mathematically evaluating the predictions of the combinations using an absolute sum of the errors model.

7. The method of claim 1 including
separately repeating steps "b" through "d" for different operating periods, including up-peak, down-peak and noon-time periods.

8. The method of claim 7 including
repeating the steps "b" through "d" for different traffic patterns, including lobby "up" boarding counts, lobby "down" de-boarding counts, and upper floor boarding counts and upper floor de-boarding counts in the "up" and "down" directions for each of said different operating periods.

* * * * *